US005335252A

United States Patent [19]

Kaufman

[11] Patent Number: 5,335,252

[45] Date of Patent: Aug. 2, 1994

[54] STEAM GENERATOR SYSTEM FOR GAS COOLED REACTOR AND THE LIKE

[76] Inventor: Jay S. Kaufman, 24 Scotland Rd., Kingston, N.H. 03848

[21] Appl. No.: 137,512

[22] Filed: Oct. 18, 1993

[51] Int. Cl.[5] ..... G21C 15/00

[52] U.S. Cl. ..... 376/402; 376/391; 60/644.1

[58] Field of Search ..... 376/402, 391; 60/203.1, 60/644.1, 678, 679, 680, 684

[56] References Cited

U.S. PATENT DOCUMENTS

| | | | |
|---|---|---|---|
| 3,575,002 | 4/1971 | Vuia | 376/402 |
| 4,007,597 | 2/1977 | Jaegtnes et al. | 376/391 |
| 4,164,849 | 8/1979 | Mangus | 376/402 |
| 4,619,809 | 10/1986 | Schluderberg | 376/402 |
| 4,641,608 | 2/1987 | Waryasz | 122/510 |

*Primary Examiner*—Daniel D. Wasil

[57] ABSTRACT

A steam generator which finds particular application as a superheater and reheater for transfer of heat from the gas coolant of a nuclear power reactor to a secondary fluid medium. The lower pressure reheater is located inside of the nuclear pressure vessel containing a reactor core, as is the high pressure main steam tube bundle which is comprised of an economizer/ evaporator tube bundle stage and an initial superheater tube bundle stage. The remaining superheater tube bundles which comprise the intermediate superheater and the finishing superheater are located outside of the nuclear pressure vessel, where they are heated regeneratively by reheat steam which is emerging from the nuclear pressure vessel at a temperature higher than required by the reheat turbine, The main steam system can be designed for either subcritical or supercritical pressure operation. The main steam tube bundle, located inside of the nuclear pressure vessel, operates with forced once-through flow while the plant is running at normal load and operates with water recirculation while the plant is running at low load and during start-up to provide satisfactory water velocities in the heat transfer tubes of the main steam tube bundle throughout the operating range. A recirculation system extracts water from a location between the tube side outlet of the initial superheater tube bundle stage and the tube side inlet of the intermediate superheater tube bundle to the tube side inlet of the economizer/evaorator tube bundle stage by means of a recirculation pump.

15 Claims, 1 Drawing Sheet

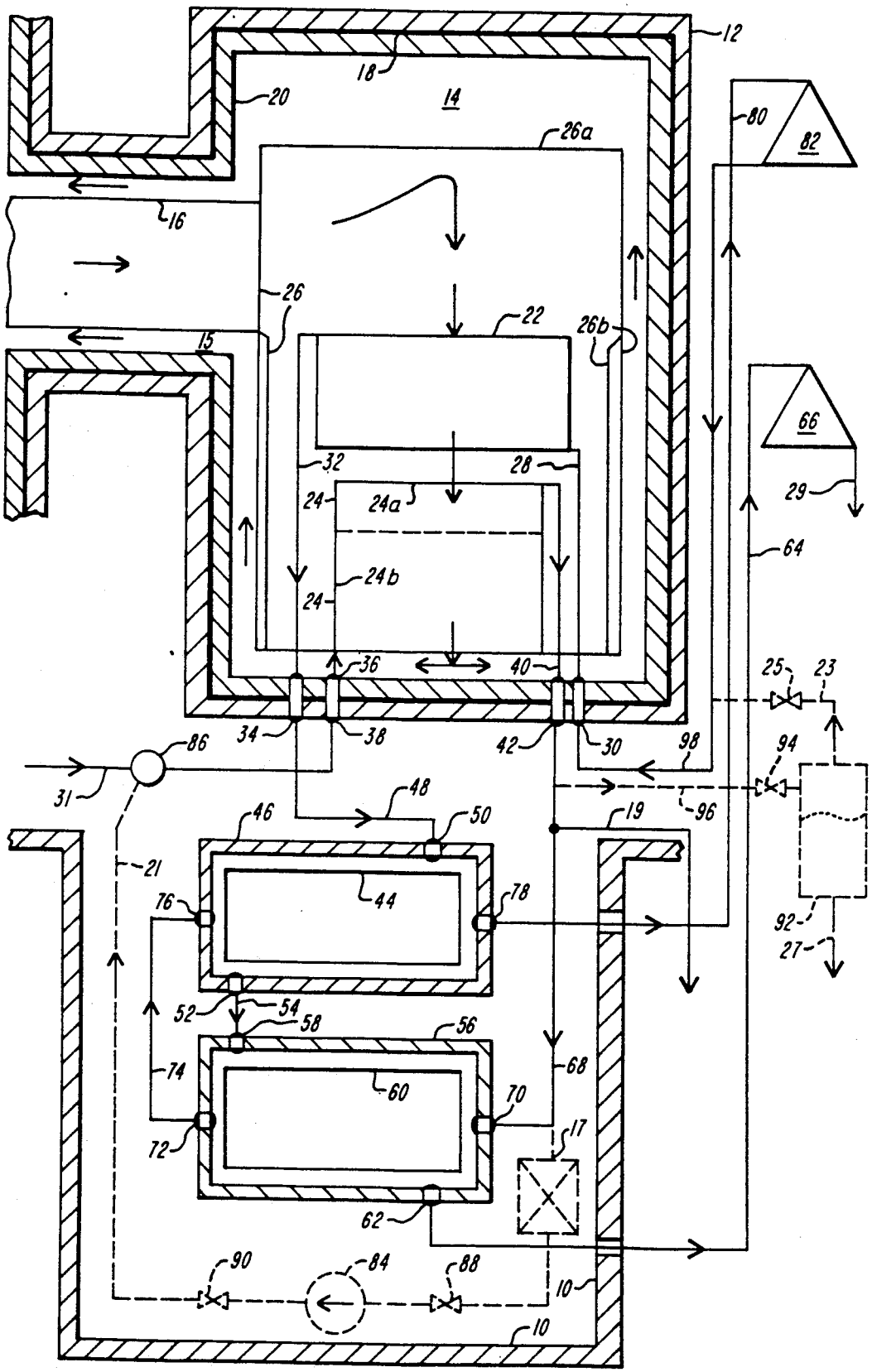
12
18
14
20
80
82
26a
16
26
22
26b
15
66
32
28
24
24a
29
64
24b
24
36
40
25
23
34
38
42
30
98
86
94
31
48
96
46
50
19
21
44
76
78
92
27
52
54
58
56
74
68
60
70
72
17
62
90
84
88
10
10

STEAM GENERATOR SYSTEM FOR GAS COOLED REACTOR AND THE LIKE

BACKGROUND OF THE INVENTION

The present invention relates to heat exchange apparatus transferring heat from a reactor primary coolant, typically helium or carbon dioxide, to a secondary fluid medium, typically water and steam, and more particularly to a novel superheating arrangement in which a reheater tube bundle located within a nuclear pressure vessel works in conjunction with superheater tube bundles which are located outside of the nuclear pressure vessel. The reheater absorbs sufficient heat from the reactor gas coolant to supply required reheat steam to the reheat turbine, and in addition the reheater absorbs excess heat at higher temperature than required to meet the reheat turbine inlet steam conditions. The excess heat contained in the reheat steam flow is transferred regeneratively to the external superheater tube bundles to raise the superheat temperature of the main steam flow to the temperature required by the main steam turbine. While it is understood that various fluids can be used for the reactor primary coolant and the secondary fluid medium, the descriptions which follow shall employ the terminology reactor gas coolant to describe the reactor primary coolant and water and or steam to describe the secondary fluid medium.

It is desirable to remove heat from gas cooled nuclear reactors by circulating superheated steam at maximum temperature to maximize volumetric and thermal efficiency. This is typically done with tubular heat exchangers specifically referred to as steam generators. A steam generator is comprised of a series of high pressure main steam tube bundles which supply steam to the high pressure main steam turbine, and a lower pressure reheat tube bundle which supplies steam to the lower pressure reheat turbine. Within the nuclear pressure vessel the main steam tube bundle is comprised of an economizer/evaporator tube bundle stage in which feedwater is raised in temperature and evaporated to steam, and an initial superheater tube bundle stage in which the main steam flow is superheated to a desired level for exit from the nuclear pressure vessel. The intermediate superheater and the finishing superheater tube bundles are contained in separate pressure vessels located outside of the nuclear pressure vessel. Steam exiting from the initial superheater tube bundle stage is raised in temperature in the intermediate superheater tube bundle until stress limitations on the heat transfer tube material require a higher grade tube material. Accordingly, the finishing superheater tube bundle, pressure vessel and other components are constructed of materials having design stress limits high enough to accomodate the final steam temperature required by the main steam turbine. A bi-metallic weld is provided between the intermediate superheater tube bundle and the finishing superheater tube bundle. Inlet and outlet penetrations in the walls of the various pressure vessels provide for passage of water and steam flow to and from the respective tube bundles.

A steam generator can be designed to make steam at subcritical (less than 3206.2 psia) pressure or supercritical (greater than 3206.2 psia) pressure. In a subcritical system water changes to steam with heat addition at constant temperature and with water density exceeding steam density, while in a supercritical system the phase change is temperature dependant, occuring without a change in density. By employing a supercritical main steam system reheat steam pressure can be raised above reactor gas coolant pressure such that radiation bearing reactor gas coolant cannot leak into reheat steam.

Because of space limitations in the nuclear pressure vessel a once-through steam generator is preferred over a drum type steam generator in gas cooled reactors. However, once-through steam generators have certain inherent problems when utilized in gas cooled reactors. In prior designs utilizing once-through steam generators in gas cooled reactors parallel tube circuits were continuous from feedwater inlet to finishing superheater outlet so that steam temperature could not be equalized among tube circuits by the use of mixing headers. Also the lack of intermediate mixing headers and confinement in the nuclear pressure vessel precluded the use of water recirculation to provide flow stability (positive upward flow in all tube circuits) during low load and start-up operation of the plant. As a result flow resistance in the form of orifices at tube circuit inlets had to be provided. Orifices imposed a large pressure drop penalty and had a predisposition to foul by build-up of deposits from impurities in the feedwater. Special feedwater demineralizer systems had to be employed to reduce fouling of the otherwise non-maintainable orifices. Another problem with the use of once-through steam generators in gas cooled reactors was protection of the bi-metallic weld which had to be located within the nuclear pressure vessel in the tubing connecting the intermediate and finishing super-heater stages. Because the bi-metallic welds were not maintainable the use of special insulation and temperature sensors was required. It has been accepted practice with once-through steam generators in gas cooled reactors to plan for plugging of failed tubes because access for replacement of these tubes was not available. The potential for tube failure was high due to vibration and wear of tubes, blockage of tubes from orifice fouling, thermal stress at bi-metallic welds, and over heating due to low flow instability, poor gas and or water/steam flow distribution, and gas hot streaks and unmixed tube side flow.

The inability to provide recirculation flow during low load and start-up operation also limited main steam outlet pressure such that it was substantially lower than reactor gas coolant pressure. High safety gas cooled reactor designs eliminated reheating from the steam generator system because of potential leakage of radiation bearing reactor gas coolant into reheat steam, leading to further reduction of main steam outlet pressure. As a result the plant was deprived of several economic advantages including thermal and volumetric efficiency and the use of standard turbine equipment.

In general the difficulties with once-through steam generators and the lack of reheaters have prevented gas cooled reactors from realizing the very high temperature capability of the graphite core. The advantages of the present invention, namely a steam generator heat removal system having once-through capability at normal load combined with capability for water recirculation at low load and during start-up, working in conjunction with a balanced pressure reheater will avail gas cooled reactors of highest temperature potential.

SUMMARY OF THE INVENTION

One of the primary objectives of the present invention is to provide a novel steam generator for gas cooled reactors which can maximize thermal and volumetric efficiencies of the plant, is relatively compact, and provides greater ease of fabrication, installation and inspection than heretofore obtainable with known gas cooled reactor steam generator heat removal systems.

A more particular object of the present invention is to provide a novel steam generator for transferring heat from a reactor gas coolant to a secondary fluid medium which may be at subcritical (less than 3206.2 psia) pressure or supercritical (greater than 3206.2 psia) pressure. The reheater portion of the steam generator is located inside of the nuclear pressure vessel, and is capable of absorbing sufficient heat to meet the requirements of the reheat system as well as the heat requirements of the finishing superheater and the intermediate superheater tube bundles, which are located outside of the nuclear pressure vessel. The excess heat absorbed by the reheater which is over and above the heat required to produce steam for the reheat turbine is transferred to the finishing superheater and intermediate superheater tube bundles by flowing steam initially at the maximum temperature attained in the reheater tube bundle, first through the shell side of the finishing superheater tube bundle, then through the shell side of the intermediate superheater tube bundle, with superheated steam meeting the requirements of the main steam turbine being produced at the tube side outlet of the finishing superheater tube bundle, before shell side steam flow continues to the reheat turbine. The initial superheater tube bundle stage, located inside of the nuclear pressure vessel, and the intermediate superheater tube bundle located, outside of the nuclear pressure vessel, are sized relative to each other so as to produce desired steam temperature and moisture requirements at the tube side outlet of the initial superheater tube bundle stage. Also, superheated steam can be diverted from the tube side outlet of the initial superheater tube bundle stage to plant feedwater heaters during continuous plant operation as a means to increase the ratio of reheat steam flow to main steam flow through the intermediate superheater and the finishing superheater tube bundles, thereby reducing the maximum steam temperature requirement at the tube side outlet of the reheater tube bundle. Reheat steam pressure is selected to be higher than reactor gas coolant pressure during continuous plant operation to prevent leakage of radioactive material into reheat steam.

In summary the steam generator of the present invention includes a reheater tube bundle designed for subcritical pressure just above reactor gas coolant pressure, located inside of the nuclear pressure vessel, and a main steam system designed for subcritical or supercritical pressure comprising an economizer/evaporator tube bundle stage and an initial superheater tube bundle stage located inside of the nuclear pressure vessel, and a finishing superheater and an intermediate superheater tube bundle, contained in separate pressure vessels, located outside of the nuclear pressure vessel.

A feature of the steam generator in accordance with the present invention lies in the ability to design the main steam system for subcritical or supercritical pressure operation.

Another feature of the steam generator in accordance with the present invention lies in the ability to employ a reheater, thereby absorbing more heat from the reactor gas coolant and operating with higher main steam pressure than with prior steam generator designs. The reheater is designed for very high temperature to regeneratively superheat main steam flow through the intermediate superheater and the finishing superheater tube bundles which are located outside of the nuclear pressure vessel. Because reheat pressure is approximately equal to reactor gas coolant pressure, creep stresses in the reheater heat transfer tubes and other reheater pressure parts are negligible. Also, the very low pressure differential across reheater heat transfer tubes and other reheater pressure parts makes modern high temperature materials, such as graphite, ceramics and special alloy steels, feasible fop fabrication of the reheaters. The inclusion of a reheater in the steam generator system allows for significantly higher main steam system pressure and for the use of standard reheat and main steam turbines, thereby improving overall plant economics.

Another feature of the steam generator in accordance with the present invention lies in the provision of water recirculation for tube side flow stability (positive up flow in all parallel main steam tube circuits) during start-up and low load operation, in which water is pumped from the initial superheater tube bundle stage outlet to the economizer/evaporator tube bundle stage inlet. This feature allows for enlargement or total elimination of flow stabilizing orifices as used in prior steam generators, resulting in reduction of steam side pressure loss at full load flow.

Another feature of the steam generator in accordance with the present invention lies in the provision of a water cooling heat exchanger at the recirculation pump inlet to produce desired water temperature and to condense excess steam at the recirculation pump inlet.

Another feature of the steam generator in accordance with the present invention lies in the ability to divert superheated steam from the outlet of the initial superheater tube bundle stage to plant feedwater heaters to increase the ratio of reheat steam flow to main steam flow through the finishing superheater and intermediate superheater tube bundles, thereby reducing the maximum steam temperature requirement at the reheater tube bundle outlet.

Another feature of the steam generator in accordance with the present invention lies in the ability to size the heat transfer tube surface area of the initial superheater tube bundle stage with respect to the heat transfer tube surface area of the intermediate superheater tube bundle to produce liquid flow at the tube side outlet of the initial superheater tube bundle stage during low load and start-up operation of the plant.

Another feature of the steam generator in accordance with the present invention lies in the ability to size the heat transfer tube surface area of the initial superheater tube bundle stage with respect to the heat transfer tube surface area of the intermediate superheater and the finishing superheater tube bundles to achieve the desired reheater tube bundle heat duty.

Another feature of the steam generator in accordance with the present invention lies in the addition of steam side mixing locations in the piping between the initial superheater tube bundle stage and the intermediate superheater tube bundle, and between the intermediate superheater and the finishing superheater tube bundles, which act to equalize the temperature of steam emerging from the intermediate superheater and from the finishing superheater tube bundles. Equalized steam temperatures at tube bundle outlets promotes steam side flow stability and reduces tube overheating.

Another feature of the steam generator in accordance with the present invention lies in the provision of a bypass system utilized during plant start-up, in which water is passed through a pressure reducing valve to a flash tank from which low pressure superheated steam is diverted to the tube side of the reheater tube bundle, and water is diverted to other plant systems.

Still another feature of the steam generator in accordance with the present invention lies in locating the finishing superheater and the intermediate superheater tube bundles outside of the nuclear pressure vessel. The bi-metallic weld is then located outside of the nuclear pressure vessel where it is readily monitored and maintained. Tube replacement instead of tube plugging or tube bundle replacement is possible. Furthermore, reliability of steam generator components including the bi-metallic weld is improved.

Further objects, advantages and features of the present invention, together with the organization and manner of operation thereof, will become apparent from the foregoing detailed description of the invention when taken in conjunction with the accompanying drawing wherein like reference numerals designate like elements throughout the several views.

DETAILED DESCRIPTION OF DRAWINGS

FIG. 1 is a schematic drawing of a gas cooled reactor steam generator system which shows the functional relationship of the steam generator, in accordance with the present invention, to the other components of the plant main steam, reheat and start-up systems.

DESCRIPTION OF PREFERRED EMBODIMENT

Referring now to the drawing FIG. 1, a schematic arrangement of a heat removal system in accordance with the present invention for transferring heat from a reactor gas coolant to a secondary fluid medium is indicated generally. Although the heat removal system finds particular application as a heat removal system in a high temperature gas cooled reactor, utilizing water and steam as the secondary fluid medium, it will become apparent herein that the inventive concept may be employed in other applications with other fluid media. In the illustrated embodiment the non-nuclear portion of the heat removal system is shown as being placed in a lower pit area 10 in close proximity to the nuclear pressure vessel 12 which contains the nuclear portions of the heat removal system, the reactor core (not shown) and other nuclear components (not shown). The nuclear pressure vessel 12 may be of steel or prestressed concrete construction. More particularly, the nuclear portion of the heat removal system is housed within a nuclear steam generator cavity 14 defined internally of the nuclear pressure vessel 12.

Turning now to a more detailed description of the heat removal system in acordance with the present invention, and referring to FIG. 1 the nuclear portion of the heat removal system is relatively compact and thus enables the nuclear steam generator cavity 14 within the nuclear pressure vessel 12 to be located below a transverse reactor gas coolant inlet duct 16 which conventionally communicates with the lower end of the core cavity (not shown) for removing reactor gas coolant therefrom. The nuclear steam generator cavity 14 is a generally cylindrical configuration and has a suitable metallic shield liner 18 establishing the outer peripheral surface of the cavity 14 and to which is suitably attached a thermal barrier 20 in a known manner.

Within the nuclear steam generator cavity 14 of the nuclear pressure vessel 12 the steam generator is comprised of the reheater tube bundle 22 and the main steam tube bundle 24 which are arranged within a metallic shroud 26 the upper end of which serves as a flow guide **26*a* to direct reactor gas coolant to the inlet of the reheater tube bundle 22, while the lower portion of the shroud 26*b* immediately surrounding the reheater tube bundle 22 and the main steam tube bundle 24 is of double wall construction to reduce heat transfer through the shroud 26*b*. The reheater tube bundle 22 is above the main steam tube bundle 24 which is comprised of the initial superheater stage 24*a* above and the economizer/evaporator stage 24*b* below. The reheater tube bundle is comprised of a plurality of heat transfer tubes arranged such that internal steam flows in parallel tube circuits which are connected by reheater lead-in tubes 28 to the reheater inlet penetration 30 in the nuclear pressure vessel 12, and by reheater lead-out tubes 32 connected to the reheater outlet penetration 34 in the nuclear pressure vessel 12. The main steam tube bundle 24 within the nuclear pressure vessel 12 is also comprised of a plurality of heat transfer tubes which are arranged such that internal water and steam flows in parallel tube circuits connected by economizer-/evaporator lead-in tubes 36 to the economizer-/evaporator inlet penetration 38 in the nuclear pressure vessel 12, and by initial superheater lead-out tubes 40 to the initial superheater outlet penetration 42 in the nuclear pressure vessel 12**.

Outside of the nuclear pressure vessel 12 the non-nuclear portions of the heat removal system are located in the lower pit area 10. The finishing superheater tube bundle 44 is contained in the finishing superheater pressure vessel 46 which is located adjacent to the nuclear pressure vessel 12 such that the length of the shell side inlet pipe 48, which carries maximum temperature shell side steam from the reheater tube bundle outlet penetration 34 in the nuclear pressure vessel 12 to the finishing superheater shell side inlet penetration 50 is minimized. Shell side steam flows from the finishing superheater shell side inlet penetration 50 through the finishing superheater tube bundle 44 and exits from the finishing superheater pressure vessel 46 through the finishing superheater shell side outlet penetration 52. Shell side steam flow continues through the shell side connecting pipe 54 and enters the intermediate superheater pressure vessel 56 through the intermediate superheater shell side inlet penetration 58, flows through the intermediate superheater tube bundle 60, to exit from the intermediate superheater pressure vessel 56 through the intermediate superheater shell side outlet penetration 62. Shell side steam flow continues through the reheat turbine inlet pipe 64 to deliver power to the reheat turbine 66, and then continues through the reheat turbine outlet pipe 29 to the plant condenser (not shown).

Tube side steam from the initial superheater outlet penetration 42 in the nuclear pressure vessel 12 flows through the tube side inlet penetration 70 in the intermediate superheater pressure vessel 56, continues through the intermediate superheater tube bundle 60, and exits from the intermediate superheater pressure vessel 56, through the intermediate superheater tube side outlet penetration 72. Tube side steam then flows through tube side connecting pipe 74 to enter the finishing superheater pressure vessel 46 through the finishing superheater tube side inlet penetration 76, flows through the finishing superheater tube bundle 44, to exit from the finishing superheater pressure vessel 46 through the finishing superheater tube side outlet penetration 78.

Steam flow continues through the main steam turbine inlet pipe 80 to the main steam turbine 82, to which it delivers power, and returns through the main steam turbine outlet pipe 98 to the reheater tube bundle inlet penetration 30 in the nuclear pressure vessel 12 for reheating.

A water recirculation system is provided to produce satisfactory water velocities in the economizer-/evaporator tube bundle stage **24*b* during low load and start-up operation. In this system water is received from the tube side inlet pipe 68 at the intermediate superheater pressure vessel 56 tube side inlet, passed through heat exchanger 17 to condense excess steam and reduce water temperature to meet recirculation pump 84 requirements, is then circulated by the recirculation pump 84 to mixing tee 86 where recirculated water is mixed with feedwater flow from the plant feedpump (not shown) coming through feedwater pipe 31. Mixed flow continues from the mixing tee 86 to the economizer-/evaporator inlet penetration 38 in the nuclear pressure vessel 12**.

A bypass system is also provided to divert excess flow from the tube side inlet pipe 68 at the intermediate superheater pressure vessel 56 tube side inlet, through the bypass pipe 96 and the pressure reducing valve 94, to the flash tank 92. Excess flow occurs because minimum water velocity requirements in the main steam tube bundle 24 may result in main steam flow above that required to operate the main steam turbine 82 during low load and start-up operation of the plant. Water and steam are separated in the flash tank 92, water being drained through flash tank drain pipe 26 to the plant condenser (not shown), and low pressure steam being diverted through the flash tank steam outlet pipe 23 and the flash tank steam outlet valve 25 to the main steam turbine outlet pipe 98 for return to the reheater tube bundle 22 during plant start-up. Low pressure steam from the flash tank 92 may also be used for hot restarts and other start-up purposes. The by-pass system also serves as a pressure relief system.

A main steam diverting pipe 19 is also provided to deliver low temperature superheated steam from the tube side inlet pipe 68 at the intermediate superheater pressure vessel 56 inlet to plant feedwater heaters (not shown). Diverting a portion of the main steam flow to feedwater heaters during continuous plant operation increases the ratio of reheat steam flow to main steam flow through the intermediate superheater tube bundle 60 and the finishing superheater tube bundle 44, thereby reducing the maximum steam temperature requirement at the reheater tube bundle 22 outlet.

In briefly reviewing the operation of the steam generator of the present invention, hot reactor gas coolant which during maximum continuous operation may be up to 1600 degrees F. ,at a pressure of approximately 700 psia. and flow rate of between 3 and 6 lb./sec.sq.ft., enters the nuclear steam generator cavity 14 from the reactor gas coolant inlet duct 16, passes into the open top of the flow guide portion of the shroud **26*a*, flows downwardly through the reheater tube bundle 22, then through the main steam tube bundle 24, and radially through the space between the bottom face of the main steam tube bundle 24 and the thermal barrier 20 on the lower surface of the nuclear pressure vessel 12. The reactor gas coolant, now at substantially lower temperature then passes upwardly within a generally annular flow area between the outer surface of the double wall portion of the shroud 26*b* and the thermal barrier 20 on the inner surface of the nuclear pressure vessel 12, then outwardly through the annular space 15** for return to the reactor core (not shown), it being understood that flow of reactor gas coolant is effected by a gas circulator (not shown).

As the reactor gas coolant passes downwardly within the shroud 26, reheat steam enters reheater inlet penetration 30 in the nuclear pressure vessel 12 simultaneously with feedwater entering the economizer-/evaporator inlet penetration 38 in the nuclear pressure vessel 12 during continuous operation of the plant. The reheat steam, which is coming from the main steam turbine outlet pipe 98, is at a temperature of approximately 575 degrees F.,flow rate of approximately 300 lb./sec.sq.ft. and pressure of approximately 700 psia. The feedwater is at an inlet temperature of approximately 350 degrees F., flow rate of approximately 400 lb./sec.sq.ft. and pressure of between 2800 and 4000 psia. The entering reheat steam passes upwardly in series through the reheater lead-in tubes 28 and the reheater tube bundle 22, while feedwater passes upwardly in series through the economizer/evaporator lead-in tubes 36, the economizer/evaporator tube bundle stage **26*b* and the initial superheater tube bundle stage 24*a*. During such upward passage within the reheater tube bundle 22, which is arranged in counterflow with respect to the reactor gas coolant flow, reheat steam increases in temperature to between 1300 and 1500 degrees F. by heat transfer from the downwardly flowing reactor gas coolant, the temperature of which is reduced to approximately 850 degrees F. upon reaching the lower end of the reheater tube bundle 22, continuing downwardly to enter the main steam tube bundle 24. Simultaneously during similar upward passage of feedwater within the economizer/evaporator tube bundle stage 24*b* and the initial superheater tube bundle stage 24*a*, which are arranged in counter flow with respect to the reactor gas coolant flow, the feedwater undergoes a phase change to superheated steam emerging at the top of the main steam tube bundle 24 at a temperature of approximately 750 degrees F. The phase change and temperature increase is effected by heat transfer from the downwardly flowing reactor gas coolant which is emerging from the reheater tube bundle 22. The temperature of the reactor gas coolant is reduced to approximately 500 degrees F. upon reaching the lower end of the main steam tube bundle 24. Reheat steam exiting from the reheater tube bundle 22 passes downwardly through the reheater lead-out tubes 32 and through the reheater outlet penetration 34 in the nuclear pressure vessel 12 where tube to tube differences in temperature are dissipated by mixing. Similarly superheated steam which is exiting from the initial superheater tube bundle stage 24*a* passes downwardly through the initial superheater lead-out tubes 40 and through the initial superheater outlet penetration 42 in the nuclear pressure vessel 12** where tube to tube differences in temperature are dissipated by mixing.

The intermediate superheater pressure vessel 56 and the finishing superheater pressure vessel 46 which ape located outside of the nuclear pressure vessel 12 contain respectively, the intermediate superheater tube bundle 60 and the finishing superheater tube bundle 44, which produce an increase in temperature of superheated steam emerging from the initial superheater tube bundle stage **24*a*, by regenerative heat transfer from high temperature excess heat which is available in the shell side reheat steam flow. The reheat steam exiting from the nuclear pressure vessel 12, which during maximum continuous operation is at a temperature of between 1300 and 1500 degrees F., a flow Pate of approximately 300 lb./sec.sq.ft. and a pressure of approximately 700 psia flows downwardly in shell side inlet pipe 48 where tube to tube temperature differences which developed in the reheater tube bundle 22 are dissipated by mixing, to enter the finishing superheater pressure vessel 46 shell side through the finishing superheater shell side inlet penetration 50. Shell side reheat steam then flows transversely across the finishing superheater tube bundle 44, which is arranged in counterflow with respect to shell side reheat steam flow and tube side main steam flow, and exits from the finishing superheater pressure vessel 46 through the finishing superheater shell side outlet penetration 52 where it enters the shell side connecting pipe 54 from which shell side reheat steam flow continues into the intermediate superheater pressure vessel 56 through the intermediate superheater pressure vessel shell side inlet penetration 58. Shell side reheat steam flow then flows transversely across the intermediate superheater tube bundle 60 which is arranged in counterflow with respect to shell side reheat steam flow and tube side main steam flow before exiting from the intermediate superheater pressure vessel 56 through the intermediate superheater shell side outlet penetration 62** at a temperature of approximately 950 degrees F.

As reheat steam flows through the shell side of the intermediate superheater tube bundle 60 and the finishing superheater tube bundle 44, main steam flow from the initial superheater tube bundle stage **24*a* passes downwardly through the initial superheater outlet penetration 42 in the nuclear pressure vessel 12, and downwardly through the intermediate superheater pressure vessel tube side inlet pipe 68 where tube to tube temperature differences which developed in the main steam tube bundle are dissipated by mixing, to split into two flow strèams in which a flow of approximately 450 lb./sec.sq.ft. at a temperature of approximately 750 degrees F. and pressure of between 2800 and 4000 psia, continues into the intermediate superheater pressure vessel 56 through the intermediate superheater tube side inlet penetration 70, while a flow of approximately 50 lb./sec.sq.ft. at a temperature of approximately 750 degrees F. and pressure of between 2800 and 4000 psia. enters the main steam diverting pipe 11 continuing on to plant feedwater heaters (not shown). Main steam flow of approximately 450 lb./sec.sq.ft. continues through the tube side of the intermediate superheater tube bundle 60 which is arranged in counterflow with respect to shell side reheat steam flow and tube side main steam flow, and exits from the intermediate superheater pressure vessel 56 through the intermediate superheater tube side outlet penetration 72 where main steam flow enters the tube side connecting pipe 74 in which tube to tube temperature differences which developed in the intermediate superheater tube bundle 60 are dissipated by mixing. Main steam flow then enters the finishing superheater pressure vessel 46 through the finishing superheater tube side inlet penetration 76, flows through the finishing superheater tube bundle 44, and exits from the finishing superheater pressure vessel 46 through finishing superheater pressure vessel tube side outlet penetration 78. During passage through the intermediate superheater tube bundle 60 and through the finishing superheater tube bundle 44 main steam flow attains a temperature of approximately 950 degrees F. and tube to tube temperature differences which developed in the finishing superheater tube bundle 44 are dissipated by mixing in the main steam turbine inlet pipe 80, before reaching the main steam turbine 82. Upon delivering power to the main steam turbine 82, main steam flow at reduced temperature and pressure returns through main steam turbine outlet pipe 98, to the reheat inlet penetration 30 in the nuclear pressure vessel 12**.

During start-up and low load operation of the plant the recirculation system and the bypass system are in operation to maintain minimum required water velocities, and thereby produce positive upward flow in all of the parallel tube circuits, in the economizer/evaporator tube bundle stage **24*b*, and the initial superheater tube bundle stage 24*a*. The recirculation system is operated by opening the inlet valve 88 and the outlet valve 90 while the recirculation pump 84 is running. The recirculation pump inlet heat exchanger 17, inlet valve 88 and outlet valve 90 are adjusted to provide a minimum flow rate of 100 lb./sec.sq.ft. at a temperature of approximately 350 degrees F. and a pressure of between 2800 and 4000 psia to the economizer/evaporator inlet penetration 38 in the nuclear pressure vessel 12. Flow in excess of approximately 133 lb./sec.sq.ft. at the initial superheater outlet penetration 42 in the nuclear pressure vessel 12 is diverted to the bypass flash tank 92** during start-up and low load operation of the plant, to maintain feedwater flow between one-quarter and one-third of maximum continuous flow.

While a preferred embodiment of the present invention has been illustrated and described it will be understood to those skilled in the art the changes and modifications that may be made therein without departing from the invention in its broader aspects. Various features of the invention are defined in the following claims.

We claim:

1. In a vapor generator heat removal system for a nuclear power plant reactor, which produces required inlet vapor conditions for the main nuclear power plant turbine and for the nuclear power plant reheat turbine, while diverting a portion of superheated vapor to plant feed system heaters, one or more reheater tube bundles comprising a plurality of parallel heat transfer tube circuits located inside of a nuclear pressure vessel, said nuclear pressure vessel also containing a nuclear reactor core, and external to said nuclear pressure vessel a finishing superheater tube bundle comprising a plurality of parallel heat transfer tube circuits contained in a finishing superheater pressure vessel and an intermediate superheater tube bundle comprising a plurality of parallel heat transfer tube circuits contained in an intermediate superheater pressure vessel, such that said reheater tube bundles absorb heat from the reactor primary coolant into a secondary vapor medium flowing inside of the heat transfer tubes of said reheater tube bundles, said heat being sufficient in quantity and at sufficiently high temperature to increase the temperature of superheated vapor flowing inside of the heat transfer tubes of said finishing superheater tube bundle and said intermediate superheater tube bundle by the flow of said secondary vapor medium first through the shell side of said finishing superheater tube bundle and then through the shell side of said intermediate superheater tube bundle, to meet the vapor temperature, pressure and flow requirements of said main nuclear power plant turbine, while said reheat secondary vapor medium retains sufficient heat to meet the vapor temperature, pressure and flow requirements of said nuclear power plant reheat turbine.

2. The apparatus of claim 1 wherein the pressure of said secondary fluid medium is higher than the pressure of said reactor primary coolant thereby preventing leakage of radioactive materials into said secondary vapor medium.

3. The apparatus of claim 1 wherein the differential pressure across said reheater heat transfer tubes and other pressure bearing parts is sufficiently low to reduce creep stresses in said reheater heat transfer tubes to acceptable levels, thereby increasing the design temperature limits and the heat absorption capabilities of said reheater tube bundles.

4. The apparatus of claim 1 wherein materials having high temperature capability such as graphite, ceramics or alloy steels are used for said heat transfer tubes, other pressure bearing parts and structural components of said reheaters.

5. The apparatus of claim 1 wherein a portion of the superheated vapor flowing from the tube side outlet of the initial superheater tube bundle stage to the tube side inlet of said intermediate superheater tube bundle can be diverted to plant feed system heaters to increase the ratio of said secondary vapor medium flowing inside the heat transfer tubes of said reheaters to said superheated vapor flow entering the tube side of said intermediate superheater tube bundle, thereby reducing the maximum temperature requirement for vapor exiting from the tube side outlet of said reheater tube bundles.

6. The apparatus of claim 1 wherein a bypass system comprised of a pressure reducing valve, flash tank and other appropriate flow control components receives flow from the tube side inlet of said intermediate superheater tube bundle during start-up operation of the plant, separates said flow into vapor and liquid, and delivers said vapor flow to the tube side inlet of said reheater tube bundles, to be raised in temperature in said reheater tube bundles, while said liquid flow is drained from said flash tank to other plant systems.

7. In a vapor generator heat removal system for a nuclear power plant reactor, which produces required inlet vapor conditions for the main nuclear power plant turbine and for the nuclear power plant reheat turbine, while diverting a portion of superheated vapor to plant feed system heaters, one of more reheater tube bundles comprising a plurality of parallel heat transfer tube circuits, an initial superheater tube bundle stage comprising a plurality of parallel heat transfer tube circuits, and an economizer/evaporator tube bundle stage comprising a plurality of parallel heat transfer tube circuits, located within a nuclear pressure vessel, said nuclear pressure vessel also containing a nuclear reactor core, wherein the tube side inlets of said initial superheater tube bundle stage are connected in series to said economizer/evaporator tube bundle stage, while the tube side outlet of said initial superheater tube bundle stage is connected in series to the tube side inlet of an intermediate superheater tube bundle having a plurality of parallel heat transfer tube circuits contained in an intermediate superheater pressure vessel located outside of said nuclear pressure vessel, the tube side outlet of which is connected to the tube side inlet of a finishing superheater tube bundle having a plurality of parallel heat transfer tube circuits contained in a finishing superheater pressure vessel also located outside of said nuclear pressure vessel , such that the heat transfer tube surface area of said initial superheater tube bundle can be sized relative to the heat transfer tube surface area of said intermediate superheater tube bundle, thereby providing for the production of desired vapor conditions of flow, temperature and pressure at the tube side outlet of said reheater tube bundles, the heat transfer tube surface area of which is dependant upon the temperature of superheated vapor emerging from said initial superheater tube bundle stage.

8. The apparatus of claim 7 wherein a recirculation system comprised of a recirculation pump, inlet heat exchanger and other appropriate flow control components is provided to recirculate fluid from the tube side outlet of said initial superheater tube bundle stage to the tube side inlet of said economizer/evaporator tube bundle stage, wherein said recirculated fluid is mixed with incoming liquid flow from the plant feed system to said tube side inlet of said economizer/evaporator tube bundle stage, such that said recirculation system may be operated during low load and start-up operation of the plant and said recirculation system may be isolated during continuous operation of said plant at normal load to allow once-through flow through the tube side of said economizer/evaporator tube bundle stage, said initial superheater tube bundle stage, said intermediate superheater tube bundle, and said finishing superheater tube bundle.

9. The apparatus of claim 7 wherein a pipe connects the tube side outlet of said initial superheater tube bundle stage with the tube side inlet of said intermediate superheater tube bundle, said pipe producing mixing of flow emerging from said tube side outlet of said initial superheater tube bundle stage, thereby delivering flow at uniform temperature through said pipe to said tube side inlet of said intermediate superheater tube bundle.

10. The apparatus of claim 7 wherein said initial superheater tube bundle stage, said economizer/evaporator tube bundle stage, said intermediate superheater tube bundle, and said finishing superheater tube bundle are designed for internal pressure exceeding the critical pressure of the fluid being circulated through the tube side of said initial superheater and said economizer-/evaporator tube bundle stages and through the tube side of said intermediate superheater and said finishing superheater tube bundles, critical pressure being defined as that pressure at which the phase change from liquid to vapor is temperature dependant and occurs without a change in density.

11. The apparatus of claim 7 wherein a portion of the superheated vapor flowing from the tube side outlet of said initial superheater tube bundle stage to the tube side inlet of said intermediate superheater tube bundle can be diverted to said plant feed system heaters to increase the ratio of reheat vapor flow to said superheated vapor flow entering the tube side of said intermediate superheater tube bundle, thereby reducing the maximum temperature requirement for vapor exiting from the tube side outlet of said reheater tube bundles.

12. In a vapor generator heat removal system for a nuclear power plant reactor, which produces required inlet vapor conditions for the main nuclear power plant turbine and for the nuclear power plant reheat turbine, one or more reheater tube bundles comprising a plurality of parallel heat transfer tube circuits, an economizer-/evaporator tube bundle stage comprising a plurality of heat transfer tube circuits, and an initial superheater tube bundle stage located inside of a nuclear pressure vessel, said nuclear pressure vessel also containing a nuclear reactor core, and external to said nuclear pressure vessel an intermediate superheater tube bundle comprising a plurality of heat transfer tubes arranged in parallel tube circuits contained in an intermediate superheater pressure vessel, and a finishing superheater tube bundle comprising a plurality of heat transfer tubes arranged in parallel tube circuits contained in a finishing superheater pressure vessel, such that the tube side inlet of said intermediate superheater pressure vessel is connected to the tube side outlet of said initial superheater, the shell side inlet of said finishing superheater is connected to the tube side outlet of said reheater tube bundles, the tube side outlet of said intermediate superheater pressure vessel is connected to the tube side inlet of said finishing superheater pressure vessel, and the shell side outlet of said finishing superheater pressure vessel is connected to the shell side inlet of said intermediate superheater pressure vessel, such that the tube side of said intermediate superheater tube bundle and the tube side of said finishing superheater tube bundle comprise a series flow arrangement from the tube side outlet of said initial superheater tube bundle to the inlet of said plant main turbine, and the shell side of said finishing superheater tube bundle, and the shell side of said intermediate superheater tube bundle comprise a series flow arrangement from the tube side outlet of said reheater tube bundle to the inlet of said plant reheat turbine.

13. The apparatus of claim 12 wherein a pipe connects the tube side outlet penetration of said intermediate superheater pressure vessel with the tube side inlet of said finishing superheater pressure vessel, said pipe producing mixing of flow emerging from the tube side outlet of said intermediate superheater tube bundle, thereby delivering flow at uniform temperature through said pipe to the tube side inlet of said finishing superheater pressure vessel.

14. The apparatus of claim 12 wherein the tube material of said finishing superheater tube bundle is upgraded from the tube material of said intermediate superheater tube bundle to a material having higher allowable and design stress capability, said tube material change being effected by the placement of a bi-metallic weld at a location between the tube side outlet of said intermediate superheater tube bundle and the tube side inlet of said finishing superheater tube bundle.

15. The apparatus of claim 12 wherein said intermediate superheater pressure vessel and said finishing superheater pressure vessel, and said intermediate superheater tube bundle and said finishing superheater tube bundle, are designed for replacement of failed tubes and designed for in-service inspection and maintenance of heat transfer tubes and other components.

* * * * *

UNITED STATES PATENT AND TRADEMARK OFFICE

CERTIFICATE OF CORRECTION

PATENT NO. : 5,335,252

DATED : August 2, 1994

INVENTOR(S) : Jay S. Kaufman

It is certified that error appears in the above-identified patent and that said Letters Patent is hereby corrected as shown below:

Column 10, line 36, "We claim:" should read -- I claim: --

Signed and Sealed this

Eleventh Day of October, 1994

*Attest:*

*Attesting Officer*

Bruce Lehman

BRUCE LEHMAN

*Commissioner of Patents and Trademarks*